US006085959A

United States Patent [19]

Lee

[11] Patent Number: 6,085,959

[45] Date of Patent: Jul. 11, 2000

[54] NAILER MAGAZINE WITH BLOCKING DEVICE

[75] Inventor: Yun-Chung Lee, Taipei Hsien, Taiwan

[73] Assignee: De Poan Pneumatic Corporation, Taipei Hsien, Taiwan

[21] Appl. No.: 09/265,519

[22] Filed: Mar. 10, 1999

[51] Int. Cl.[7] ..... B25C 1/04

[52] U.S. Cl. ..... 227/120

[58] Field of Search ..... 227/120, 135, 227/136, 119, 109

[56] References Cited

U.S. PATENT DOCUMENTS

| | | | |
|---|---|---|---|
| 4,801,062 | 1/1989 | Austin | 227/120 |
| 5,054,678 | 10/1991 | Nasiatka | 227/120 |
| 5,615,819 | 4/1997 | Hou et al. | 227/109 |
| 5,632,431 | 5/1997 | Lin | 227/119 |
| 5,743,453 | 4/1998 | Chuang | 227/120 |
| 5,975,350 | 11/1999 | Han | 227/120 |

*Primary Examiner*—Scott A. Smith
*Attorney, Agent, or Firm*—Pro-Techtor International Services

[57] ABSTRACT

A nailer magazine with blocking device, comprising: a magazine body, having a rear end and an opening running along a longitudinal direction; a gliding body, inserted in the magazine body through the rear end thereof, glidingly movable in the longitudinal direction; and a blocking device. Two grooves are cut into the magazine body along the longitudinal direction, ending in rear entrances and having groove extensions. The gliding body has two lateral projections, which are glidingly movable in the grooves of the magazine body and have blocking elements attached, which are accommodated in the groove extensions. The blocking device is located close to the rear entrances and blocks the blocking elements from leaving the groove extensions through the rear entrances. By locating the blocking elements inside the magazine body, exposure to external impacts is avoided and good looks of the nailer magazine are not impaired.

2 Claims, 6 Drawing Sheets

NAILER MAGAZINE WITH BLOCKING DEVICE

BACKGROUND OF THE INVENTION

1. Field of the Invention

The present invention relates to a nailer magazine with blocking device, particularly to a nailer magazine with blocking device for a nailer using straight nails.

2. Description of Related Art

A conventional magazine for a nailer with an ejection head serves to house a sufficient number of nails and to push nails into the ejection head. In use, after all nails have been ejected, a user has to open the magazine and to refill nails.

As shown in FIG. 6, a conventional magazine for a nailer with an ejection head 41 comprises: a magazine body 1, having a front end that is mounted next to the ejection head 41, a rear end and an accommodating groove for accommodating nails; and a gliding body 2, inserted into the magazine body 1 through the rear end thereof and carrying the nails. Then inserted in the magazine body 1, the gliding body 2 blocks the nails in the accommodating groove from falling out. When the gliding body 2 is pulled out of the magazine body 1, the accommodating groove is accessible for refilling the nails.

In order to keep the gliding body 2, when pulled out, connected with the magazine body 1, a pair of blocking plates 3 is attached to the gliding body 2 at the front end thereof. When the gliding body 2 is pulled out, the blocking plates 3 glide closely along the magazine body 1 and are finally stopped by blocking screws 4 at the rear end of the magazine body 1, such that the gliding body 2 will not separate from the magazine body 1.

However, the gliding body 2 and the blocking plates 3 lie outside the magazine body 1 and are thus exposed. Since the blocking plates 3 are made of metal, shocks lead to deformation thereof, such that the screws fail to stop the blocking plates 2 and the gliding body 2 is separated from the magazine body 1. Furthermore, the blocking plates 3 outside the magazine body 1 look ugly and are easily caught by cords or hooks.

SUMMARY OF THE INVENTION

It is therefore an object of the present invention to provide an nailer magazine with blocking device, which has a reduced volume.

Another object of the present invention is to provide an nailer magazine with blocking device, which stably pushes nails forward and thus works with increased reliability.

The present invention can be more fully understood by reference to the following description and accompanying drawings.

DETAILED DESCRIPTION OF THE PREFERRED EMBODIMENT

Figure 1:
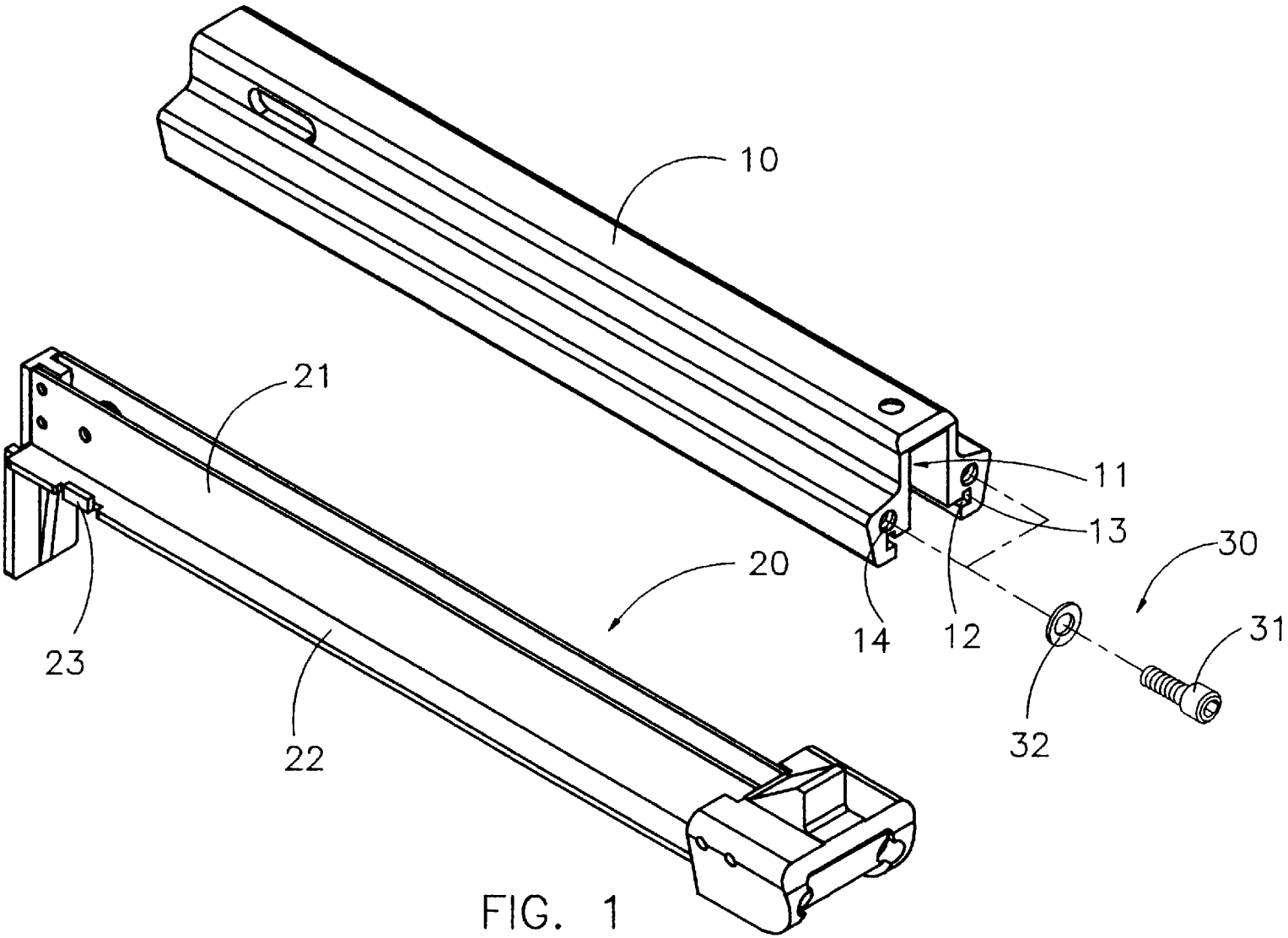
FIG. 1 is an exploded perspective view of the nailer magazine with blocking device of the present invention.
Figure 2:
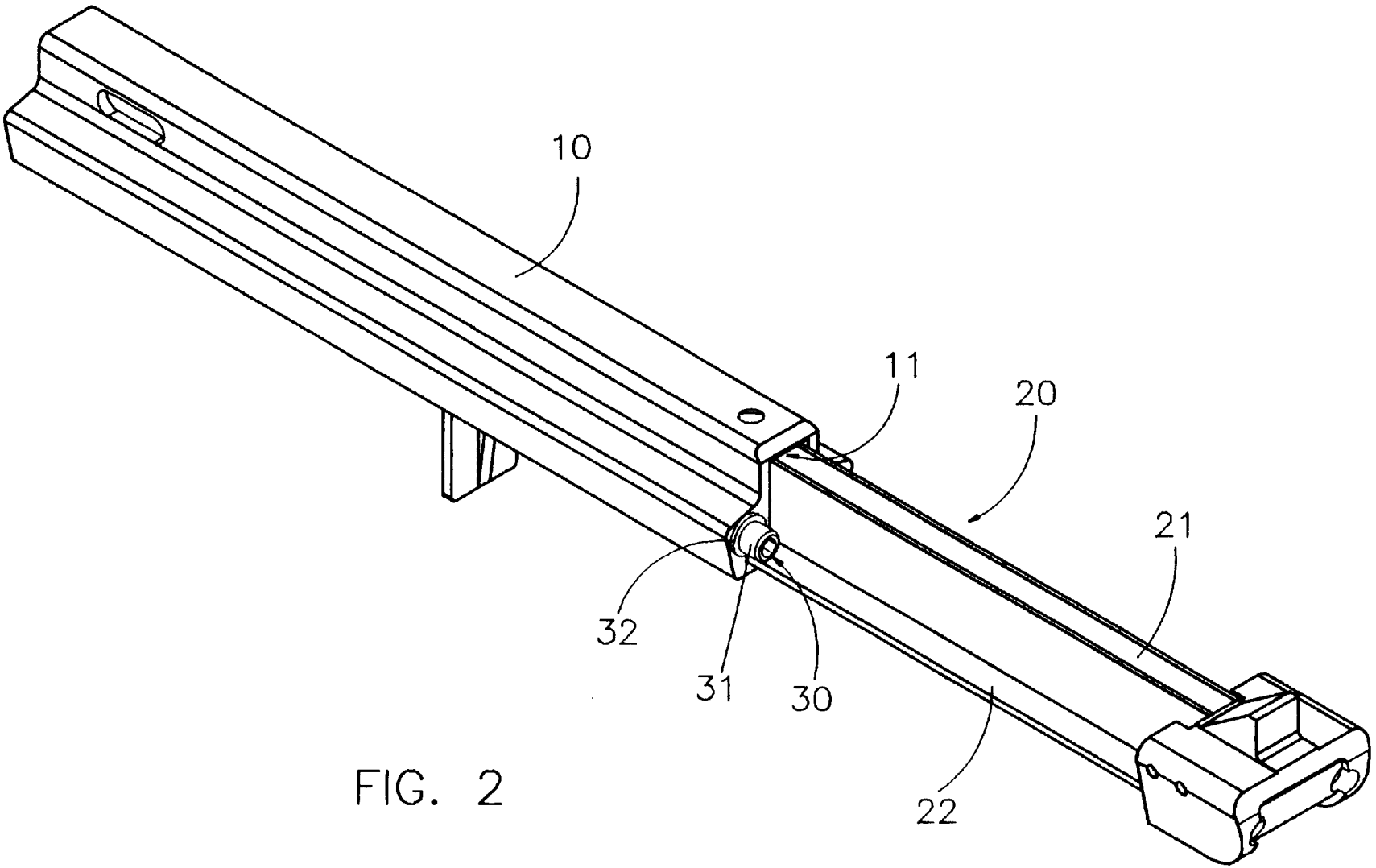
FIG. 2 is a perspective view of the nailer magazine with blocking device of the present invention after assembly.

The nailer magazine with blocking device of the present invention is used on a nailer 40. As shown in FIGS. 1 and 2, the nailer magazine with blocking device of the present invention mainly comprises: a magazine body 10 with an outer side, a front end and a rear end; a gliding body 20, glidingly movable inside the magazine body 10 in a longitudinal direction and carrying the nails; and a blocking device 30. A pair of central longitudinal ridges 21 extends from the front end of the gliding body 20 to the rear end thereof, having a lateral distance, equal heights lower edges, from which two lateral projections 22 extend away.

Figure 3:
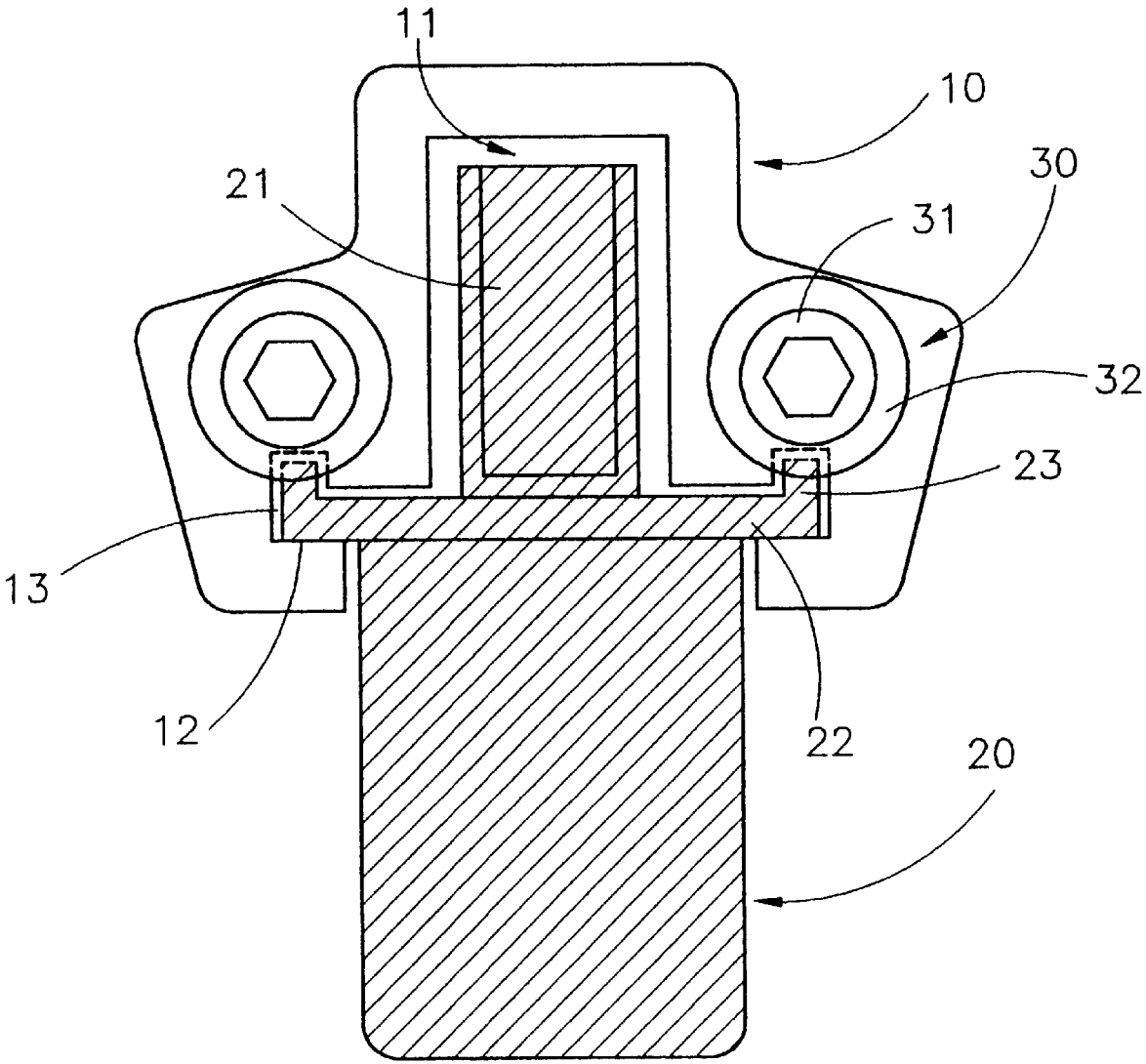
FIG. 3 is a cross-sectional view of the nailer magazine with blocking device of the present invention.
Figure 4:
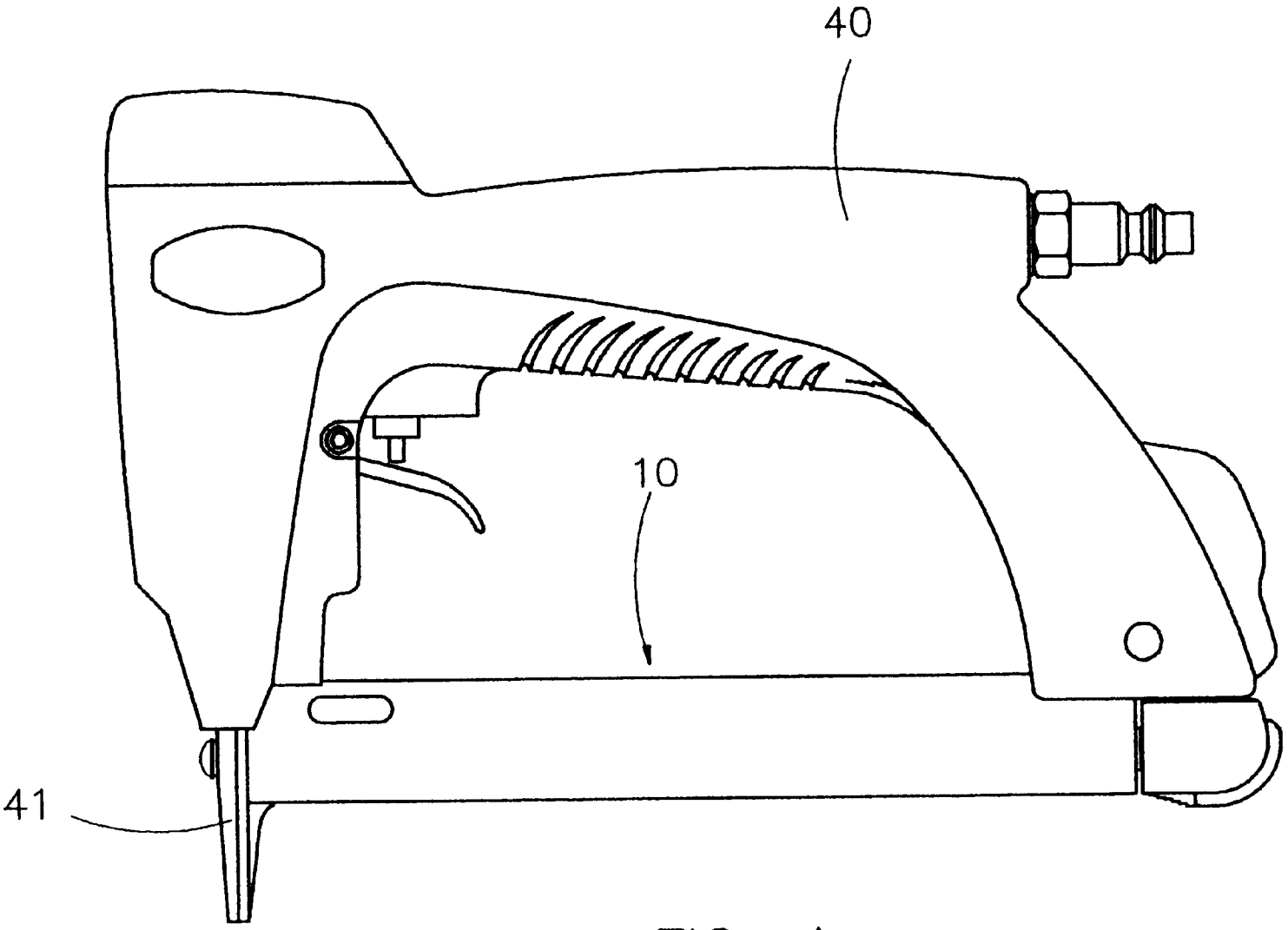
FIG. 4 is a side view of the nailer magazine with blocking device of the present invention in conjunction with a nailer.

Referring to FIG. 1, the magazine body 10 has a central longitudinal opening 11, which has a width and a depth, which are larger than the distance and the heights of the pair of ridges 21. Two longitudinal grooves 12 are cut in the magazine body 10 on two sides of the opening 11. The grooves 12 end in rear entrances at the rear end of the magazine body 10. As shown in FIGS. 2 and 3, the grooves 12 accommodate the two lateral projections 22, allowing the two lateral projections 22 to glide in the longitudinal direction. Thereby the magazine body 10 and the gliding body 20 are connected with each other.

Figure 5:
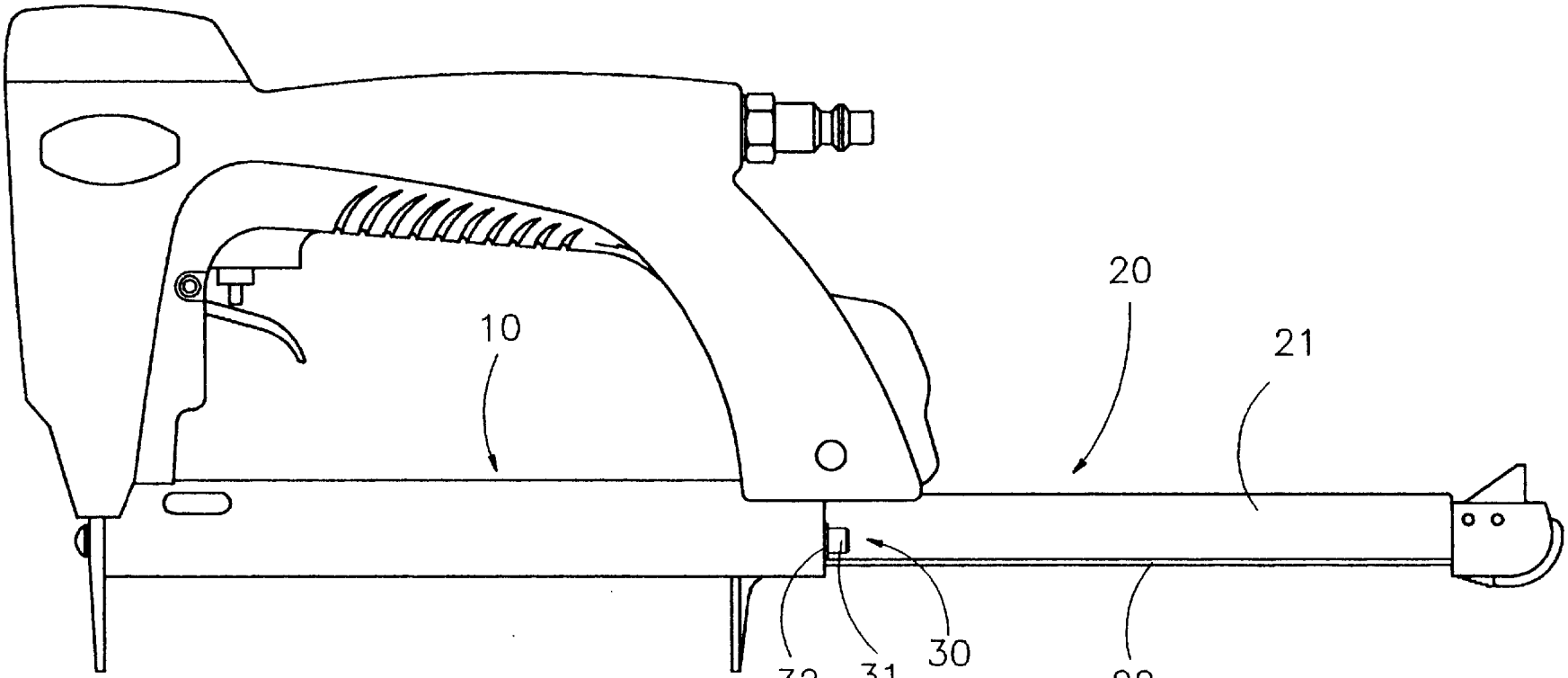
FIG. 5 is a schematic illustration of the nailer magazine with blocking device of the present invention, when opened.
Figure 6:
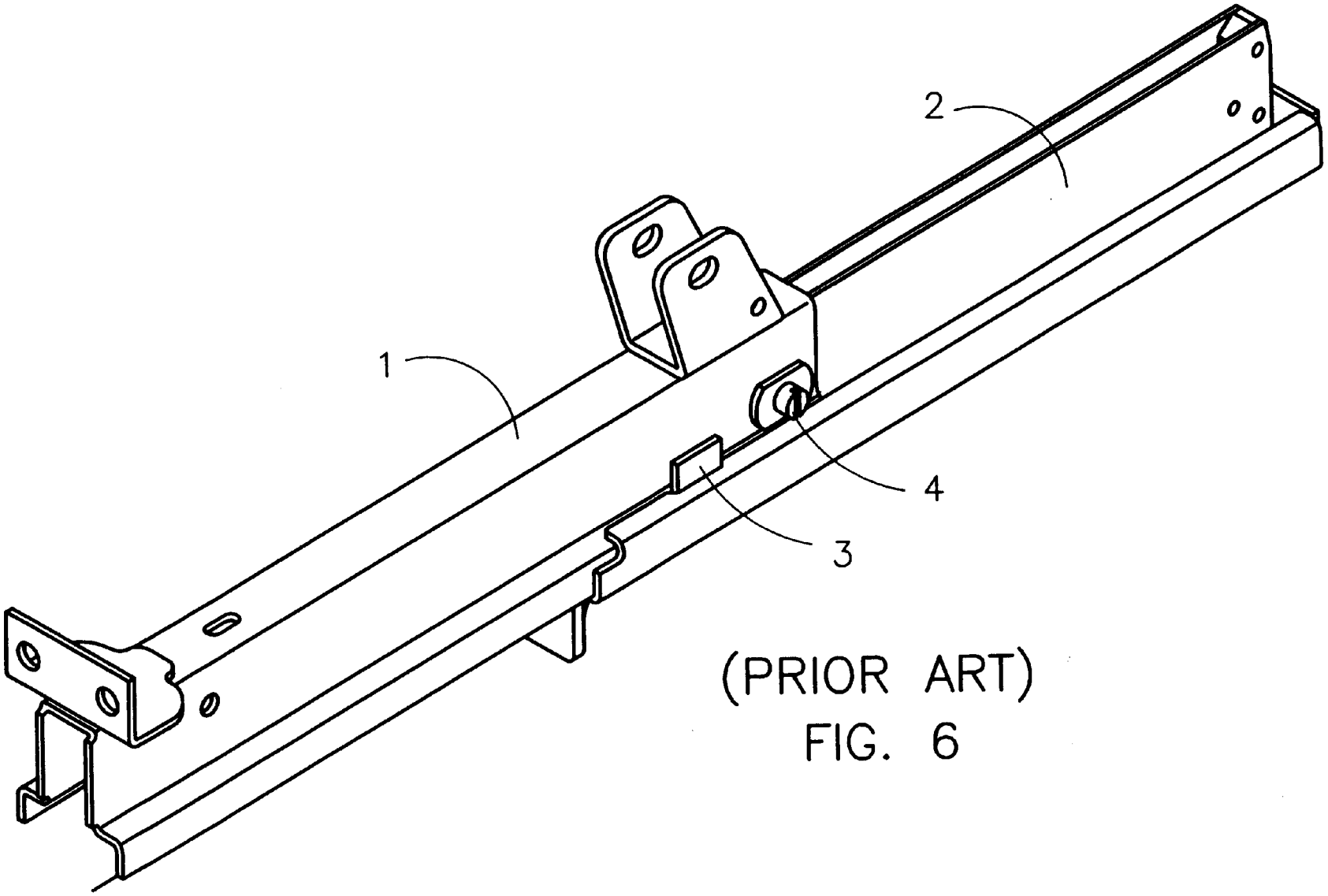
(PRIOR ART) FIG. 6
FIG. 6 is a perspective view of a conventional nailer magazine.

Referring to FIGS. 2 and 5, the gliding body 20 is inserted through the rear end of the magazine body 10 into the opening 11 thereof, guided by the two lateral projections 22 gliding through the rear entrances into the grooves 12. Pushing the gliding body 20 to the front end of the magazine body 10, leaves the opening 11 covered. Pulling the gliding body 20 towards the rear end of the magazine body 10, allows to access the opening 11 from outside.

The main characteristic of the present invention lies in how the gliding body 20 is blocked from being completely pulled out of the magazine body 10. As shown in FIGS. 1 and 3, two blocking elements 23 are attached to the lateral projections 22, close to the front end of the gliding body 20. Alternatively, a single blocking element 23 is attached to one of the lateral projections 22. The grooves 12 in the magazine body 10 have groove extensions 13, continuing from the grooves 12 at a right angle and, as the grooves 12, reaching from the front end to the rear end of the magazine body 10 until the rear entrances. The groove extensions 13 accommodate the blocking elements 23, allowing the blocking elements 23 to glide therein.

The blocking device 30 is located on the rear end of the magazine body 10, blocking the blocking elements 23 from leaving the groove extensions 13. The blocking device 30 has at least one blocking unit, comprising a screw 31 and a washer 32. Furthermore, two threaded holes 14 for the screws 31 are cut into the rear end of the magazine body 10, close to the groove extensions 13. As shown in FIGS. 2 and 3, with the washer 32 of the at least one blocking unit around the screw 31 and the screw 31 in one of the threaded holes 14, the blocking elements 23 are blocked from leaving the groove extensions 13. Thus the gliding body 20, when pulled back towards the rear end of the magazine body 10, the blocking elements 23 touch the washer 32 and are held back thereby, such that the gliding body 20 is kept unseparated from the magazine body 10.

The main advantage of the present invention is that the blocking elements 23 are located inside the grove extensions 13 of the magazine body 10 and thus not exposed. When the nailer 40 is used, the blocking elements 23 will not suffer from shocks and resulting deformations and thus will work reliably. Furthermore, good looks of the nailer magazine will not be impaired by the blocking elements 23, and the blocking elements 23 will not be caught by other objects.

While the invention has been described with reference to a preferred embodiment thereof, it is to be understood that modifications or variations may be easily made without departing from the spirit of this invention which is defined by the appended claims.

What is claimed is:

1. A nailer magazine with blocking device, comprising:

a magazine body with a front end and a rear end, which define a longitudinal direction, with an opening running along said longitudinal direction inside said magazine body and two grooves cut into said magazine body along said longitudinal direction, having rear entrances, at least one of said grooves being extended by a groove extension, ending in at least one of said rear entrances;

a gliding body, inserted in said magazine body through said rear end thereof, glidingly movable in said longitudinal direction and having two lateral projections, which are glidingly movable in said grooves of said magazine body, with at least one of said lateral projections having a blocking element attached, which is glidingly movable in said at least one groove extension; and a blocking device, located close to said rear entrances and blocking said blocking element of said at least one of said lateral projections from leaving said groove extension through said rear entrance.

2. A nailer magazine with blocking device according to claim 1, wherein said blocking device has at least one blocking unit, said at least one blocking unit further comprising:

a washer, blocking said blocking element of said at least one of said lateral projections from leaving said groove extension; and a screw, fixing said washer on said magazine body.

* * * * *